US011417457B2

(12) United States Patent
Tanaka et al.

(10) Patent No.: US 11,417,457 B2
(45) Date of Patent: Aug. 16, 2022

(54) WIRE WOUND INDUCTOR COMPONENT

(71) Applicant: Murata Manufacturing Co., Ltd., Kyoto-fu (JP)

(72) Inventors: Akira Tanaka, Nagaokakyo (JP); Sunao Noya, Nagaokakyo (JP); Tomotaka Gotohda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 330 days.

(21) Appl. No.: 16/891,376

(22) Filed: Jun. 3, 2020

(65) Prior Publication Data

US 2020/0402705 A1 Dec. 24, 2020

(30) Foreign Application Priority Data

Jun. 21, 2019 (JP) ..... JP2019-115389

(51) Int. Cl.
*H01F 17/04* (2006.01)
*H01F 27/29* (2006.01)
*H01F 27/28* (2006.01)

(52) U.S. Cl.
CPC ..... *H01F 27/292* (2013.01); *H01F 17/045* (2013.01); *H01F 27/2823* (2013.01)

(58) Field of Classification Search
CPC ..... H01F 17/045; H01F 17/04; H01F 27/02; H01F 27/24
See application file for complete search history.

(56) References Cited

U.S. PATENT DOCUMENTS 5,963,119 A * 10/1999 Takeda ..... H01F 17/045 336/200
6,157,283 A * 12/2000 Tsunemi ..... H01F 27/292 336/200

(Continued)

FOREIGN PATENT DOCUMENTS

JP 2002-110428 A 4/2002
JP WO2010-067515 A1 5/2012

(Continued)

OTHER PUBLICATIONS

An Office Action; "Notice of Reasons for Refusal," mailed by the Japanese Patent Office dated Feb. 8, 2022, which corresponds to Japanese Patent Application No. 2019-115389 and is related to U.S. Appl. No. 16/891,376 with English language translation.

*Primary Examiner* — Sherman Ng
(74) *Attorney, Agent, or Firm* — Studebaker & Brackett PC

(57) ABSTRACT

The wire wound inductor component includes a core including a columnar shaft portion extending in a first direction and first and second support portions at both end portions of the shaft portion, first and second terminal electrodes provided respectively on the first and second support portions, and a wire wound around the shaft portion. A distance between an upper surface of the shaft portion and a top surface of the first and second support portions in a second direction orthogonal to the first direction is defined as a top surface step, and a distance between a lower surface of the shaft portion and a bottom surface of the first and second support portions in the second direction is defined as a bottom surface step. The top and bottom surface steps are identical with each other, and the top and bottom surface steps are less than or equal to 50 μm.

14 Claims, 5 Drawing Sheets

(56) References Cited

U.S. PATENT DOCUMENTS

| | | | | |
|---|---|---|---|---|
| 6,480,083 | B1 * | 11/2002 | Toi | H01F 27/292 336/200 |
| 2003/0071704 | A1 * | 4/2003 | Toi | H01F 27/36 336/83 |
| 2017/0076861 | A1 * | 3/2017 | Hasegawa | H01F 41/10 |
| 2017/0125157 | A1 * | 5/2017 | Hess | H01F 27/24 |
| 2017/0287634 | A1 * | 10/2017 | Baba | H01F 27/29 |
| 2017/0330672 | A1 * | 11/2017 | Uchida | H01F 27/292 |
| 2018/0308621 | A1 | 10/2018 | Tanaka et al. | |

FOREIGN PATENT DOCUMENTS

| | | | |
|---|---|---|---|
| JP | 2017163099 | A | 9/2017 |
| JP | 2018-182182 | A | 11/2018 |

* cited by examiner

WIRE WOUND INDUCTOR COMPONENT

CROSS-REFERENCE TO RELATED APPLICATION

This Applications claims benefit of priority to Japanese Patent Application No. 2019-115389, filed Jun. 21, 2019, the entire content of which is incorporated herein by reference.

BACKGROUND

Technical Field

The present disclosure relates to a wire wound inductor component.

Background Art

In the past, various kinds of inductor components have been mounted on an electronic device. A wire wound inductor component includes a core and a wire wound around the core. The core includes a shaft portion on which the wire is wound, and a support portion which is provided at both ends of the shaft portion and which protrudes in a direction intersecting with the axial direction of the shaft portion. A terminal electrode is formed on the support portion, as described, for example, in Japanese Unexamined Patent Application Publication No. 2017-163099.

In the inductor component described above, the shaft portion is made thinner than the support portion so that the outer size of the component is not affected by the winding of the wire. In addition, in the inductor component, due to the height of the terminal electrode required at the time of mounting and the interval required between the terminal electrode and the lower surface of the shaft portion, a bottom surface step, which is a distance between the lower surface of the shaft portion and the bottom surface of the support portion in the height direction, is usually secured at a certain level or more. However, when attempting to secure a certain level or more of the bottom surface step, the shaft portion is made thinner since the size of the inductor component is being reduced. When the shaft portion, which is a portion where magnetic flux concentrates, is made thinner, then the high frequency impedance characteristics of the inductor component may not be secured.

SUMMARY

Accordingly, the present disclosure provides a wire wound inductor component capable of achieving both size reduction and securing of high frequency impedance characteristics.

A wire wound inductor component of preferred embodiments of the present disclosure includes a core including a shaft portion that is columnar and extends in a first direction and a first support portion and a second support portion respectively provided at a first end portion and a second end portion of the shaft portion in the first direction. The wire wound inductor component further includes a first terminal electrode provided on the first support portion, a second terminal electrode provided on the second support portion, a wire having a first end that is connected to the first terminal electrode and a second end that is connected to the second terminal electrode wound around the shaft portion, and a cover member that is provided at least between the first support portion and the second support portion and covers a top surface of the shaft portion. A distance between the upper surface of the shaft portion and a top surface of the first support portion and the second support portion in a second direction orthogonal to the first direction is defined as a top surface step. A distance between a lower surface of the shaft portion and a bottom surface of the first support portion and the second support portion in the second direction is defined as a bottom surface step. The top surface step and the bottom surface step are identical with each other and are less than or equal to 50 μm.

Other features, elements, characteristics and advantages of the present disclosure will become more apparent from the following detailed description of preferred embodiments of the present disclosure with reference to the attached drawings.

DETAILED DESCRIPTION

Hereinafter, an embodiment will be described.

It should be noted that constituting elements may be exaggerated in accompanying drawings to facilitate understanding. The dimensional ratio of the constituting elements may differ from that of actual components or may differ from that in other figures. Although hatching is provided in the sectional view, the hatching of some components may be omitted for ease of understanding.

Figure 1:
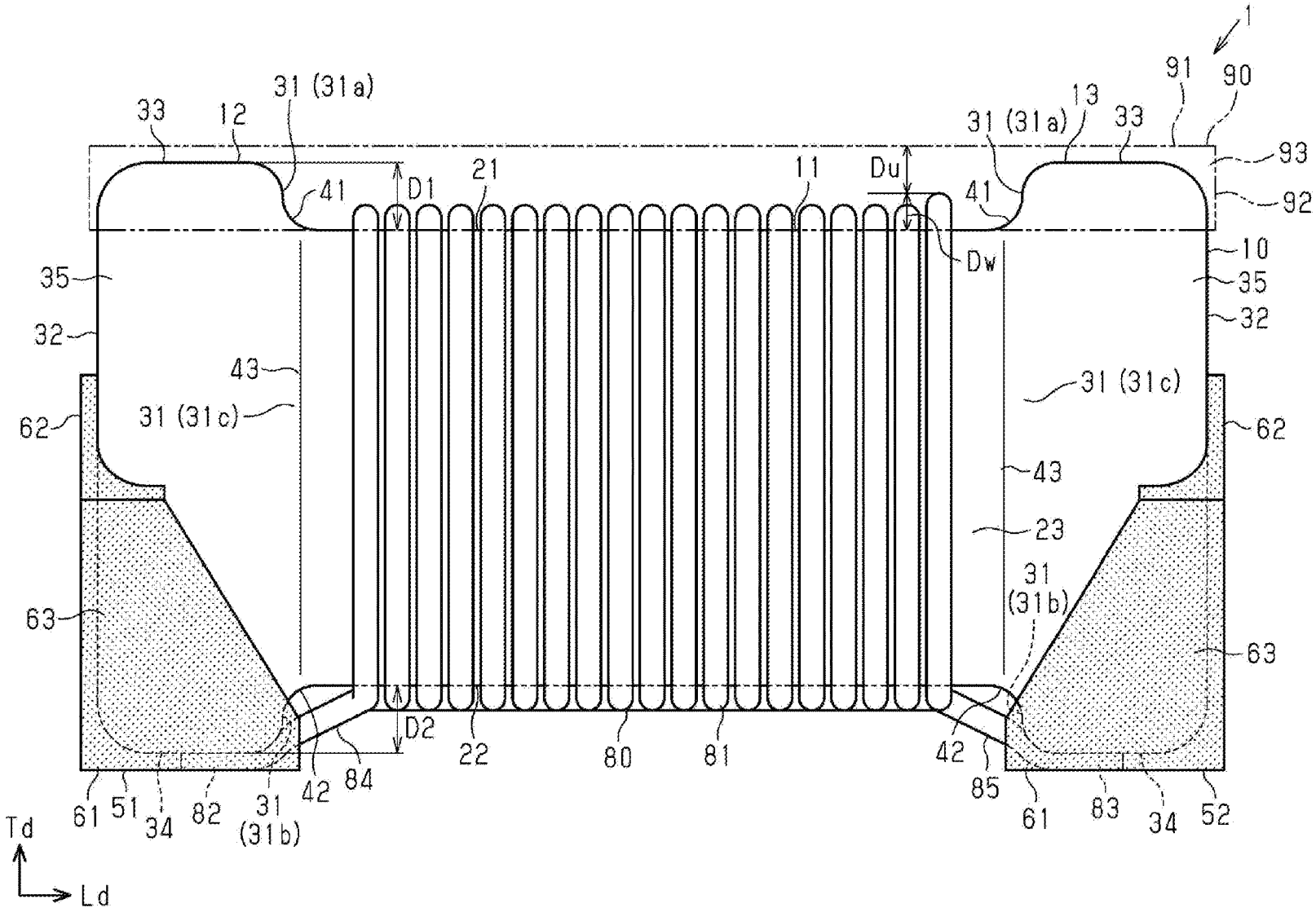
FIG. 1 is an elevational view of a wire wound inductor component according to an embodiment.
Figure 2:
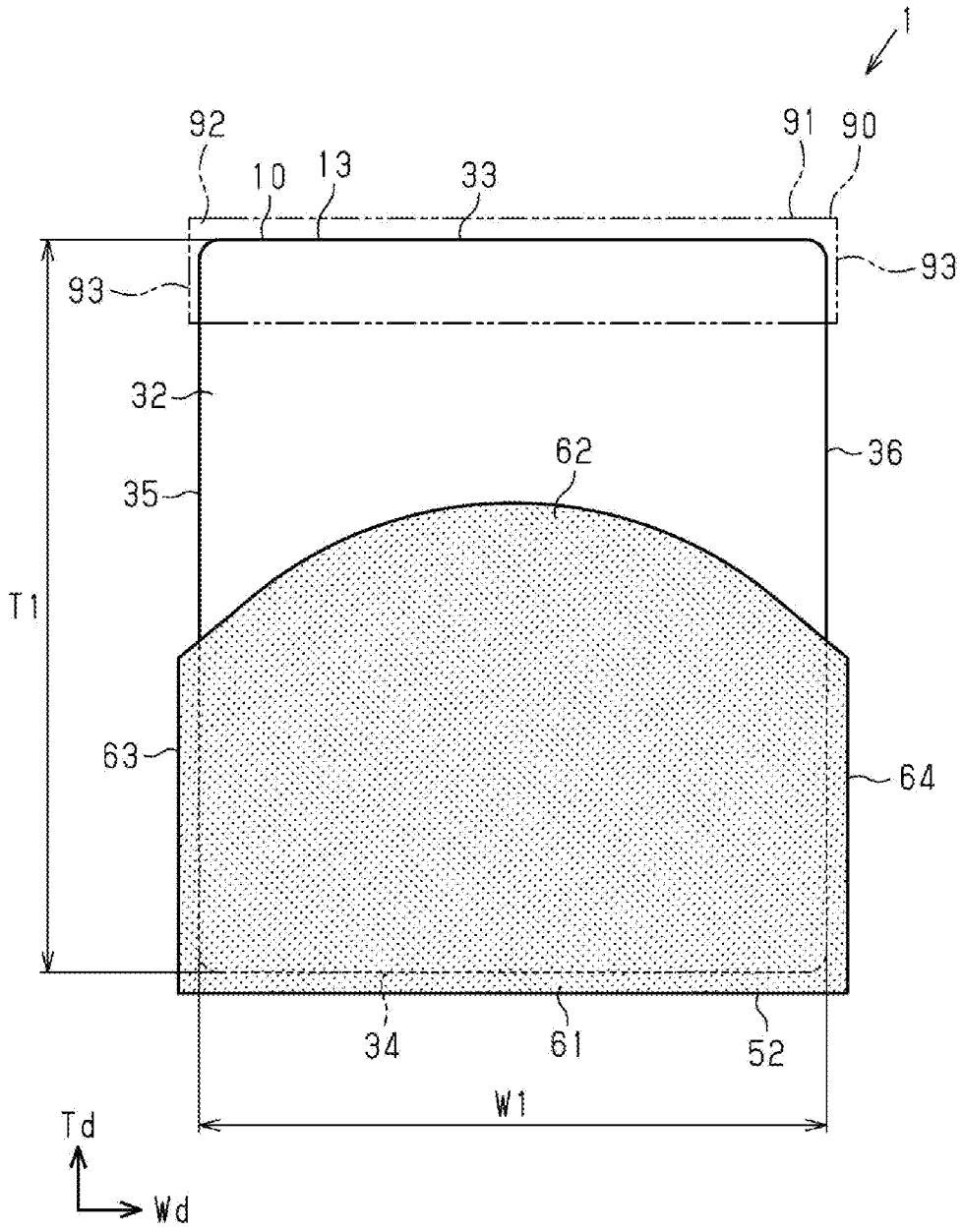
FIG. 2 is an end view of the wire wound inductor component according to the embodiment.
Figure 3:
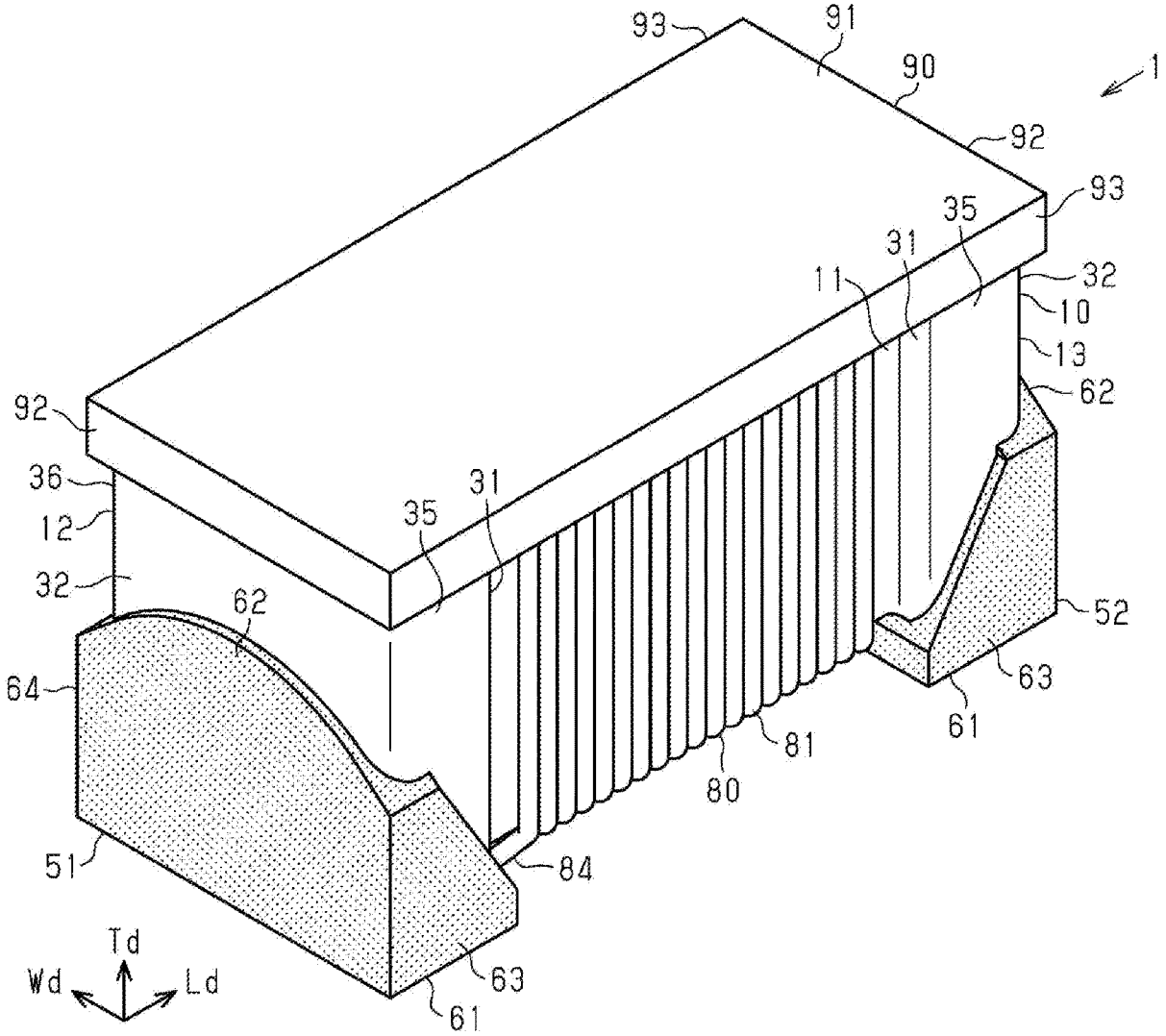
FIG. 3 is a perspective view of the wire wound inductor component according to the embodiment.

A wire wound inductor component 1 illustrated in FIG. 1, FIG. 2, and FIG. 3 is a surface mount type component mounted in or on a circuit board or the like, for example. The wire wound inductor component 1 may be used in a variety of devices including portable electronic devices (mobile electronic devices), for example, such as smart phones or mobile electronic devices for wrist (for example, smart watches).

The wire wound inductor component 1 includes a core 10, a first terminal electrode 51, a second terminal electrode 52, a wire 80, and a cover member 90. In FIG. 1 and FIG. 2, the cover member 90 is illustrated by a two-dot dash line.

The core 10 includes a columnar shaft portion 11 extending in a first direction Ld, and a first support portion 12 and a second support portion 13 respectively provided on a first end portion and a second end portion of the shaft portion 11 in the first direction Ld.

The shaft portion 11 has, for example, a quadrangular prism shape. The shaft portion 11 includes an upper surface 21 and a lower surface 22 on both sides in a second direction Td, and a pair of side surfaces 23 and 24 on both sides in a third direction Wd.

The first support portion 12 and the second support portion 13 have a main surface with rectangular plate-shape, the main surface extends in the second direction Td and the third direction Wd both orthogonal to the first direction Ld at the first end portion and the second end portion of the shaft portion 11.

The first support portion 12 and the second support portion 13 support the shaft portion 11 in parallel to a circuit board in or on which the wire wound inductor component 1 is mounted. The first support portion 12 and the second support portion 13 are formed integrally with the shaft portion 11. It is preferable that the corner portion and the ridge line portion of the shaft portion 11, the first support portion 12, and the second support portion 13 have a curved surface or a flat surface by barrel finishing, chamfering, or the like.

As illustrated in FIG. 1 and FIG. 2, the first support portion 12 and the second support portion 13 include an inner surface 31 facing toward the shaft portion 11 side in the first direction Ld, an end surface 32 facing outward opposing the inner surface 31, a top surface 33 and a bottom surface 34 on both sides in the second direction Td, and a pair of side surfaces 35 and 36 on both sides in the third direction Wd. The inner surface 31 of the first support portion 12 faces the inner surface 31 of the second support portion 13. The bottom surface 34 is a surface facing a circuit board when the wire wound inductor component 1 is mounted in or on the circuit board. The side surfaces 35 and 36 are surfaces that are not the inner surface 31, the end surface 32, the top surface 33, and the bottom surface 34.

The side surface 35 of the first support portion 12 and the second support portion 13 faces substantially the same direction with the side surface 23 of the shaft portion 11, and the side surface 36 of the first support portion 12 and the second support portion 13 faces substantially the same direction with the side surface 24 of the shaft portion 11. The top surface 33 of the first support portion 12 and the second support portion 13 faces substantially the same direction with the upper surface 21 of the shaft portion 11, and the bottom surface 34 of the first support portion 12 and the second support portion 13 faces substantially the same direction with the lower surface 22 of the shaft portion 11.

In this specification, the second direction Td is a direction perpendicular to a circuit board when the wire wound inductor component 1 is mounted in or on the circuit board among directions perpendicular to the first direction Ld, and the third direction Wd is a direction parallel to the circuit board among directions perpendicular to the first direction Ld. Therefore, the second direction Td is a direction perpendicular to the bottom surface 34, and the third direction Wd is a direction parallel to the bottom surface 34.

Figure 4A:
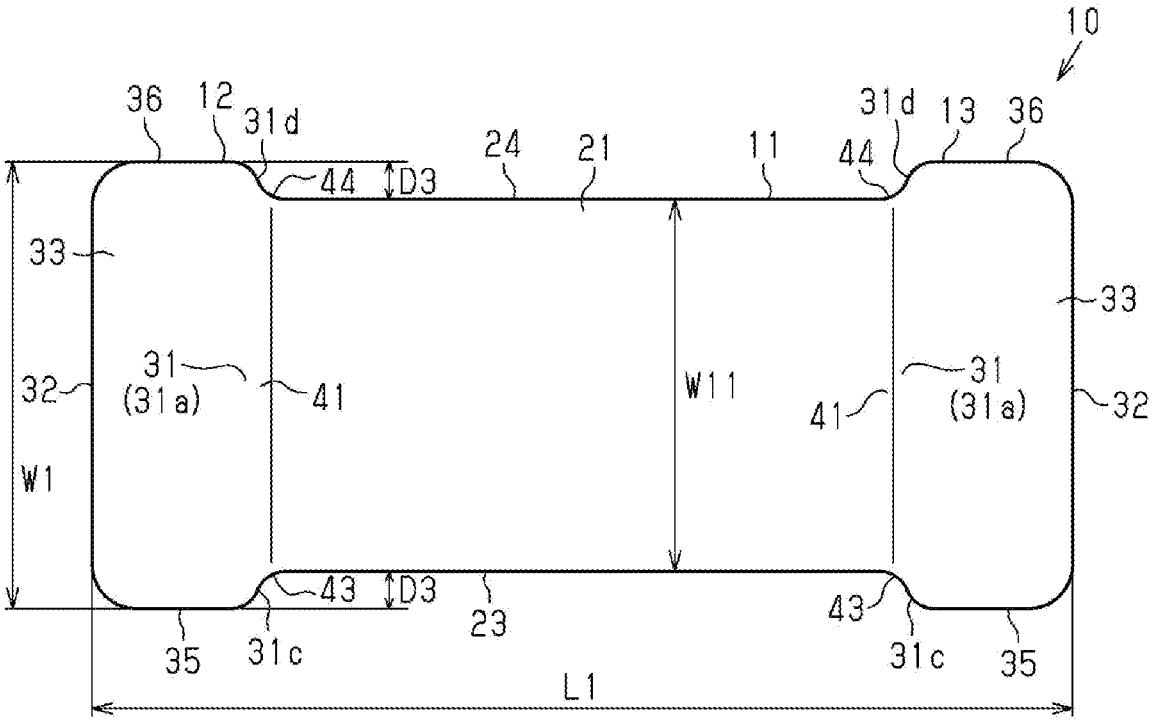
FIG. 4A is a plan view of a core.

The "height dimension T1 of the core" to be described later is a height along the second direction Td of the core 10, and specifically, as illustrated in FIG. 2, is a dimension between the top surface 33 and the bottom surface 34. The "width dimension W1" is a width along the third direction Wd of the core 10, and specifically, as illustrated in FIG. 2, is a dimension between the pair of side surfaces 35 and 36. The "length dimension L1" is a length along the first direction Ld of the core 10, and as illustrated in FIG. 4A, is a dimension between the end surface 32 of the first support portion 12 and the end surface 32 of the second support portion 13.

As a material of the core 10, a magnetic material (for example, nickel (Ni)—zinc (Zn) based ferrite, manganese (Mn)—Zn based ferrite), alumina, a metal magnetic material, or the like may be used. The powder of these materials is compacted and sintered to provide the core 10. Further, the core 10 may be a molded product made of a resin containing magnetic powder.

The first terminal electrode 51 and the second terminal electrode 52 are provided on the first support portion 12 and the second support portion 13. The first terminal electrode 51 and the second terminal electrode 52 increase in height from the end portion on the side of the inner surface 31 to the side of the end surface 32 on the first support portion 12 and the second support portion 13. Here, the height is a dimension along the second direction Td.

The first terminal electrode 51 and the second terminal electrode 52 include a bottom surface portion electrode 61 on the bottom surface 34, an end surface portion electrode 62 on the end surface 32, and side surface portion electrodes 63 and 64 on the side surfaces 35 and 36. The bottom surface portion electrode 61 is entirely formed on the bottom surface 34. The end surface portion electrode 62 is formed to cover a lower portion which is a part of the end surface 32. The end surface portion electrode 62 is formed so as to continue from the bottom surface portion electrode 61 through a portion on the ridge line between the end surface 32 and the bottom surface 34.

The center portion in the third direction Wd of the end surface portion electrode 62 is higher than the both ends in the third direction Wd at the end surface 32. The upper end of the end surface portion electrode 62 has an arc shape convex to the upper side (the top surface 33 side). Further, both end portions of the end surface portion electrode 62 in the third direction Wd are higher than the side surface portion electrodes 63 and 64 of the side surfaces 35 and 36.

The side surface portion electrodes 63 and 64 are formed to cover a lower portion which is a part of the side surfaces 35 and 36. The side surface portion electrodes 63 and 64 are formed so as to continue from the bottom surface portion electrode 61 and the end surface portion electrode 62 through a portion on the ridge line portion, respectively. Then, the side surface portion electrodes 63 and 64 gradually increase in height from the inner surface 31 to the end surface 32 in the third direction Wd, and have the highest height at the end surface portion electrode 62. It is preferable that the height of the end surface portion electrode 62 be higher than half of the height of the first support portion 12 and the second support portion 13, that is, the height T1 of the core 10.

The surface area of the first terminal electrode 51 and the second terminal electrode 52 increases when the height of the portion covering the end surface 32 of the first support portion 12 and the second support portion 13 increases. The increase in the surface area allows the mounting solder to form a high fillet along the end surface portion electrode 62 when the wire wound inductor component 1 is mounted in or on a circuit board, thereby further improving the fixing force of the wire wound inductor component 1 to a circuit board. In particular, even when the wire wound inductor component 1 is reduced in size, the fixing force is easily secured.

Furthermore, since the height of the first terminal electrode 51 and the second terminal electrode 52 at the inner surface 31 of the first support portion 12 and the second support portion 13 may be set independently with the height of the end surface portion electrode 62, the height of the first terminal electrode 51 and the second terminal electrode 52 at the inner surface 31 may be reduced without affecting the fixing force of the wire wound inductor component 1 to a circuit board. Thus, a top surface step D1 and a bottom surface step D2 may be made smaller in the wire wound inductor component 1. The height of the first terminal electrode 51 and the second terminal electrode 52 at the inner surface 31 may be zero, that is, the first terminal electrode 51 and the second terminal electrode 52 may not be formed at the inner surface 31.

The first terminal electrode 51 and the second terminal electrode 52 are formed by baking a conductive paste containing silver (Ag) as a conductive component by a dipping method or the like, for example, and may be plated with such as Ni, copper (Cu), tin (Sn), or the like, as appropriate.

As described above, both the bottom surfaces 34 of the first support portion 12 and the second support portion 13 are surfaces where the bottom surface portion electrode 61 is entirely formed on. That is, when the wire wound inductor component 1 is seen as a single component, the surface of the first support portion 12 and the second support portion 13 at the side where the first terminal electrode 51 and the second terminal electrode 52 are entirely formed on respectively, is defined as the bottom surface 34, and the second direction Td is defined as the direction perpendicular to the bottom surface 34.

The wire 80 includes, for example, a core wire having a circular cross section and a coating material coating the surface of the core wire. As a material of the core wire, for example, a conductive material such as Cu or Ag may be used as a main component. As a material of the coating material, for example, an insulating material such as polyurethane or polyester, polyamide-imide, or the like may be used.

When the cross section of the wire 80 is circular, a diameter of the cross section, which is a wire diameter, is preferably in the range of 14 μm to 20 μm, and more preferably in the range of 15 μm to 17 μm, for example. In this embodiment, the wire diameter of the wire 80 is about 16 μm. When the wire diameter of the wire 80 is large, it is possible to suppress an increase in a resistance component, and when the wire diameter of the wire 80 is small, it is possible to stay within the outer diameter of the core 10.

The wire 80 includes a winding portion 81 wound around the shaft portion 11, a first end 82 and a second end 83 connected to the first terminal electrode 51 and the second terminal electrode 52 respectively, and crossover portions 84 and 85. The crossover portion 84 bridges between the first end 82 and the winding portion 81, and the crossover portion 85 bridges between the second end 83 and the winding portion 81. Although the winding portion 81 is wound around the shaft portion 11 so as to form, for example, a single layer on the shaft portion 11, the winding portion 81 may be wound so as to form a plurality of layers.

The first end 82 and the second end 83 are electrically connected to the first terminal electrode 51 and the second terminal electrode 52, respectively. For example, solder may be used for connection between the first end 82 and the first terminal electrode 51, and between the second end 83 and the second terminal electrode 52. For example, an Sn plated layer is formed on the surfaces of the first terminal electrode 51 and the second terminal electrode 52, and the first end 82 and the second end 83 are thermocompression-bonded respectively, whereby the coating material is dissolved and volatilized by heat and the core wire is buried in the Sn plated layer, so that the first end 82 and the second end 83, and the first terminal electrode 51 and the second terminal electrode 52 may electrically be connected, respectively. The method for connecting the first end 82 and the second end 83 of the wire 80 to the first terminal electrode 51 and the second terminal electrode 52 is not limited to the above, and various known methods may be used. For example, the coating material of the first end 82 and the second end 83 is peeled off in advance and the first end 82 and the second end 83 are welded to the first terminal electrode 51 and the second terminal electrode 52, respectively.

The cover member 90 is a member made of resin, and is formed so as to cover the winding portion 81 of the wire 80 wound around the shaft portion 11. In the present embodiment, the cover member 90 is formed so as to cover the upper surface 21 of the shaft portion 11, and the top surfaces 33 of the first support portion 12 and the second support portion 13. The cover member 90 includes a top surface 91 facing the same direction in the second direction Td with the top surface 33 of the first support portion 12 and the second support portion 13, a pair of end surfaces 92 on both sides in the first direction Ld, and a pair of side surfaces 93 on both sides in the third direction Wd. The top surface 91 of the cover member 90 is a flat surface. The cover member 90 forms the top surface 91 which is a flat surface for suction so that suction by the suction nozzle of the automatic surface mount machine is surely carried out, for example, when the wire wound inductor component 1 is mounted in or on a circuit board.

As illustrated in FIG. 1, the uppermost surface of the winding portion 81 wound around the shaft portion 11, that is, the surface farthest from the upper surface 21 of the winding portion 81 on the upper surface 21 of the shaft portion 11 is the uppermost surface of the wire 80, since the wire 80 includes the winding portion 81 wound around the shaft portion 11. The thickness Du of the cover member 90 on the winding portion 81 of the wire 80 is defined as a distance between the uppermost surface of the winding portion 81 on the upper surface 21 of the shaft portion 11 and the top surface 91 of the cover member 90 along the second direction Td. Note that when the winding portion 81 is wound to form a plurality of layers on the shaft portion 11, the uppermost surface of the winding portion 81 is an uppermost surface of an uppermost layer of the winding portion 81 that is wound. It is preferable that the thickness Du of the cover member 90 be smaller than the wire diameter of the wire 80. Thus, the cover member 90 may be made thinner, the protruding amount of the cover member 90 in the first direction Ld and the third direction Wd with respect to the core 10 may be suppressed, and the outer dimension of the wire wound inductor component 1 may further be reduced.

Figure 4B:
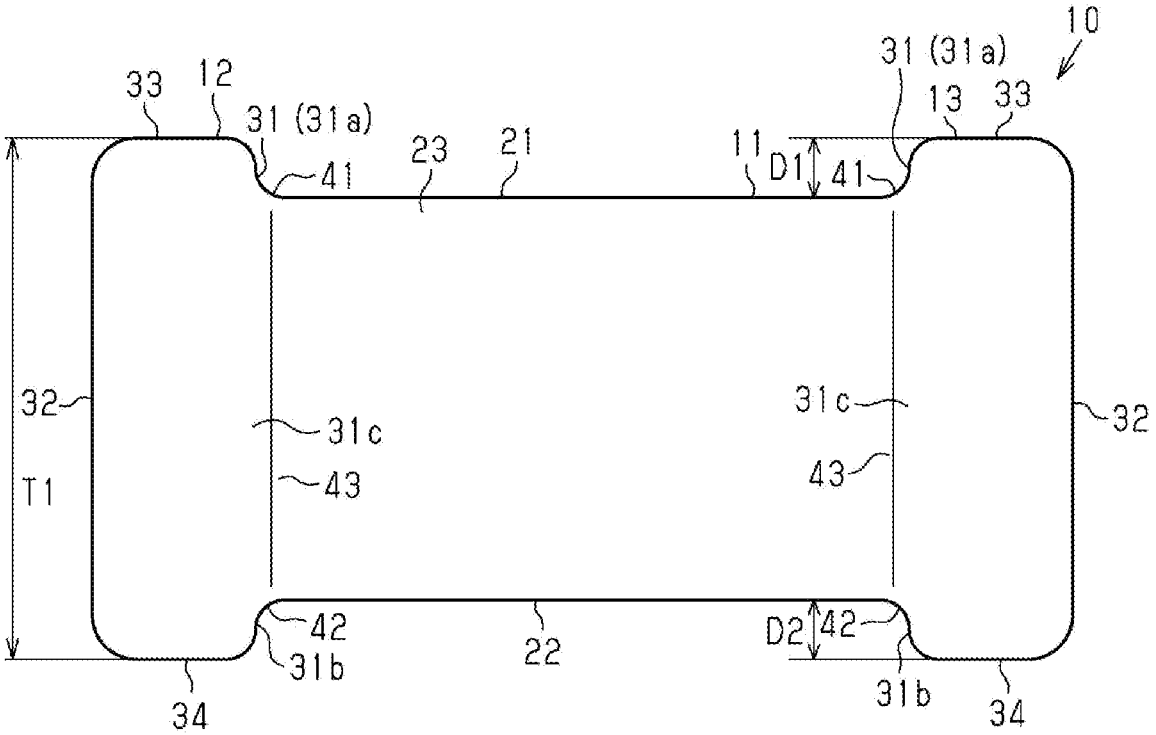
FIG. 4B is an elevational view of the core.

As illustrated in FIG. 4A and FIG. 4B, the core 10 of the present embodiment has a length dimension L1 of 1.0 mm, a height dimension T1 of 0.35 mm, and a width dimension W1 of 0.3 mm, for example. Note that the length dimension L1, the height dimension T1, and the width dimension W1 of the core 10 are not limited to the above. For example, in the core 10, the length dimension L1 may be greater than or equal to 0.6 mm and less than or equal to 1.6 mm (i.e., from 0.6 mm to 1.6 mm), the height dimension T1 may be greater than or equal to 250 μm and less than or equal to 400 μm (i.e., from 250 μm to 400 μm), and the width dimension W1 may be greater than or equal to 200 μm and less than or equal to 350 μm (i.e., from 200 μm to 350 μm). Thus, the possibility of contact with adjacent other components, or materials in the first direction Ld, the second direction Td, and the third direction Wd may be reduced.

It is preferable that the height dimension T1 of the core 10 be larger than the width dimension W1 of the core 10, and the difference between the height dimension T1 and the width dimension W1 be in the range of greater than or equal to 30 μm and less than or equal to 70 μm (i.e., from 30 μm to 70 μm). With the core 10 described above, it is possible to reduce the size of the wire wound inductor component 1 while maintaining its characteristics.

As described above, main surface of the first support portion 12 and the second support portion 13 orthogonal to the first direction Ld at the both end portions of the shaft portion 11 has a rectangular plate shape. In the first support portion 12 and the second support portion 13, the top surface 33, the bottom surface 34, and the side surfaces 35 and 36 are located outside of the upper surface 21, the lower surface 22, and the side surfaces 23 and 24 of the shaft portion 11 with the shaft portion 11 being the center. Therefore, the core 10 has a step between each surface of the shaft portion 11 and each surface of the first support portion 12 and the second support portion 13.

Specifically, as illustrated in FIG. 4B, the core 10 has the top surface step D1 which is a distance in the second direction Td between the upper surface 21 of the shaft portion 11 and the top surface 33 of the first support portion 12 and the second support portion 13. The top surface step D1 is a difference between a position (height) of the upper surface 21 and a position (height) of the top surface 33 in the second direction Td.

Further, the core 10 has the bottom surface step D2 which is a distance between the lower surface 22 of the shaft portion 11 and the bottom surface 34 of the first support portion 12 and the second support portion 13. The bottom surface step D2 is a difference between the position (height) of the lower surface 22 and the position (height) of the bottom surface 34 in the second direction Td.

As illustrated in FIG. 4A, the core 10 has a side surface step D3 which is a distance between the side surfaces 23 and 24 of the shaft portion 11 and the side surfaces 35 and 36 of the first support portion 12 and the second support portion 13. The side surface step D3 is, in the third direction Wd, a difference between the position of the side surface 23 and the position of the side surface 35, and also a difference between the position of the side surface 24 and the position of the side surface 36. The side surface step D3 is a half of the difference between a width dimension W11 of the shaft portion 11 and the width W1 of the first support portion 12 and the second support portion 13.

Although the top surface step D1, the bottom surface step D2 and the side surface step D3 are obtained as an average of the steps in the first support portion 12 and the second support portion 13, when the first support portion 12 and the second support portion 13 have a symmetrical shape, the step in either one of the first support portion 12 and the second support portion 13 may be defined as the top surface step D1 and the bottom surface step D2. With respect to the side surface step D3, when the first support portion 12 and the second support portion 13 have a symmetrical shape in the third direction Wd, one of the distance between the side surface 23 and the side surface 35 and the distance between the side surface 24 and the side surface 36 may be set as the side surface step D3.

In the wire wound inductor component 1, the top surface step D1 and the bottom surface step D2 are the same, and the top surface step D1 and the bottom surface step D2 are less than or equal to 50 μm.

The top surface step D1 and the bottom surface step D2 may be set to a further preferable range based on, for example, the height dimension T1 of the first support portion 12 and the second support portion 13.

It is preferable that the top surface step D1 and the bottom surface step D2 be less than or equal to 15% and greater than or equal to 5% (i.e., from 5% to 15%) of the height dimension T1 of the first support portion 12 and the second support portion 13. For example, when the height dimension T1 of the first support portion 12 and the second support portion 13 is set to 300 μm, the top surface step D1 and the bottom surface step D2 are preferably less than or equal to 45 μm and greater than or equal to 15 μm (i.e., from 15 μm to 45 μm). Thus, the core 10 may be reduced in size. Further, the cover member 90 may be made thinner.

Further, the top surface step D1 and the bottom surface step D2 may be set to a further preferable range based on, for example, the width dimension W1 of the first support portion 12 and the second support portion 13.

It is preferable that the top surface step D1 and the bottom surface step D2 be less than or equal to 10% and greater than or equal to 5% (i.e., from 5% to 10%) of the width dimension W1 of the first support portion 12 and the second support portion 13. For example, when the width dimension W1 is set to 300 μm, the top surface step D1 and the bottom surface step D2 are preferably less than or equal to 30 μm and greater than or equal to 15 μm (i.e., from 15 μm to 30 μm). Thus, the core 10 may be reduced in size. Further, the cover member 90 may be made thinner.

In the core 10 of the present embodiment, the height dimension T1 of the first support portion 12 and the second support portion 13 is 350 μm, the width dimension W1 of the first support portion 12 and the second support portion 13 is 300 μm, and the top surface step D1 and the bottom surface step D2 are 25 μm.

By reducing the top surface step D1 and the bottom surface step D2, resin to be the cover member 90 may be thinly applied. Thus, the protruding amount of the cover member 90 in the first direction Ld and the third direction Wd from the core 10 may be suppressed, and the outer dimension of the wire wound inductor component 1 may further be reduced.

The core 10, of which the top surface step D1 and the bottom surface step D2 are the same, has a symmetrical shape in the second direction Td. By making such a symmetrical shape, there may be eliminated the directivity of the core 10 in the second direction Td in forming the first terminal electrode 51 and the second terminal electrode 52, and the manufacturing efficiency of the wire wound inductor component 1 may be greatly improved.

The top surface step D1 is larger than the diameter of the wire 80. With this, when the resin to be the cover member 90 is applied to the upper surface 21 of the shaft portion 11, the wire 80 may easily be covered with the resin. Therefore, the wire 80 may be protected from a suction nozzle or the like which suctions the wire wound inductor component 1. Further, a distance Dw between the upper surface 21 of the shaft portion 11 and the uppermost surface of the winding portion 81 of the wire 80 is more preferably larger than half of the top surface step D1, that is, higher than the central position between the upper surface 21 of the shaft portion 11 and the top surface 33 of the first support portion 12 and the second support portion 13, thereby making it possible to make the resin thinner.

Further, the cover member 90 preferably covers the top surface 33 of the first support portion 12 and the second support portion 13, whereby the adhesion strength of the cover member 90 to the core 10 may be improved.

The inner surface 31 of each of the first support portion 12 and the second support portion 13 includes a top inner surface 31*a*, a bottom inner surface 31*b*, a side inner surface 31*c*, and a side inner surface 31*d*. The top inner surface 31*a* is the inner surface 31 on the top surface 33 side, that is, the inner surface 31 located between the upper surface 21 of the shaft portion 11 and the top surface 33 of the first support portion 12 and the second support portion 13. The bottom inner surface 31*b* is the inner surface 31 on the bottom surface 34 side, that is, the inner surface 31 located between the lower surface 22 of the shaft portion 11 and the bottom surface 34 of the first support portion 12 and the second support portion 13. The side inner surface 31*c* is the inner surface 31 on the side surface 35 side, that is, the inner surface 31 located between the side surface 23 of the shaft portion 11 and the side surface 35 of the first support portion 12 and the second support portion 13. The side inner surface 31*d* is the inner surface 31 on the side surface 36 side, that is, the inner surface 31 located between the side surface 24 of the shaft portion 11 and the side surface 36 of the first support portion 12 and the second support portion 13.

As illustrated in FIG. 4B, in the core 10, an angle formed by the top inner surface 31*a* and the top surface 33 of the first support portion 12 and the second support portion 13 is substantially a right angle. The angle formed by the bottom inner surface 31*b* and the bottom surface 34 of the first support portion 12 and the second support portion 13 is substantially a right angle. The angle formed by the top inner surface 31*a* and the top surface 33 is substantially the same as the angle formed by the bottom inner surface 31*b* and the bottom surface 34. As illustrated in FIG. 4A, the angle formed by the side inner surface 31*c* and the side surface 35 of the first support portion 12 and the second support portion 13 is an obtuse angle larger than a right angle. The angle formed by the side inner surface 31*d* and the side surface 36 of the first support portion 12 and the second support portion 13 is an obtuse angle larger than a right angle. The angle formed by the side inner surface 31*c* and the side surface 35 is substantially the same as the angle formed by the side inner surface 31*d* and the side surface 36. In the present embodiment, it is preferable that an angle formed by the top inner surface 31*a* and the top surface 33 and an angle formed by the bottom inner surface 31*b* and the bottom surface 34 be smaller than an angle formed by the side inner surface 31*c* and the side surface 35, and an angle formed by the side inner surface 31*d* and the side surface 36. Note that an angle formed by the two surfaces of the core 10 represents an angle of the inner side of the core 10, that is, an interior angle.

In the step of forming the first terminal electrode 51 and the second terminal electrode 52 on the core 10, Ag paste which becomes the first terminal electrode 51 and the second terminal electrode 52 is applied to the bottom surface 34 of the first support portion 12 and the second support portion 13 by a dipping method. The Ag paste is applied not only to the bottom surface 34 but also to the bottom inner surface 31*b*, and the Ag paste may wet up on the bottom inner surface 31*b* after application. Thus, the first terminal electrode 51 and the second terminal electrode 52 may be formed in proximity to, or in adhesion to the winding portion 81 of the shaft portion 11. In the case above, a short circuit and a damage to the coating material tend to occur since the first terminal electrode 51, the second terminal electrode 52, or the mounting solder adhering to the first terminal electrode 51 and the second terminal electrode 52 come into contact with the winding portion 81 wound around the shaft portion 11.

Here, as described above, when the bottom surface 34 on which the first terminal electrode 51 and the second terminal electrode 52 are formed is selected from the surfaces of the first support portion 12 and the second support portion 13 which have relatively small angle with the inner surface 31, the bottom inner surface 31*b* extends from the bottom surface 34 in a direction not approaching the winding portion 81 wound around the shaft portion 11, so that it is possible to suppress the proximity or adhesion of the first terminal electrode 51 and the second terminal electrode 52 to the winding portion 81 wound around the shaft portion 11.

It is preferable that the angle formed by the bottom inner surface 31*b* and the bottom surface 34 of the first support portion 12 and the second support portion 13 be smaller than any of the angles respectively formed by the side inner surfaces 31*c* and 31*d* and the side surfaces 35 and 36 of the first support portion 12 and the second support portion 13, and the angle formed by the top inner surface 31*a* and the top surface 33 of the first support portion 12 and the second support portion 13.

In addition, in the above description, the angle formed by the bottom inner surface 31*b* and the bottom surface 34, and the angle formed by the top inner surface 31*a* and the top surface 33 are substantially a right angle, and the angle formed by the side inner surfaces 31*c* and 31*d* and the side surfaces 35 and 36 are obtuse angles, however, it is not limited to this and it is sufficient when the relative relationship described above is achieved. For example, an angle formed by the top inner surface 31*a* and the top surface 33 and an angle formed by the bottom inner surface 31*b* and the bottom surface 34 may be obtuse angles or obtuse angles close to a right angle.

As illustrated in FIG. 4A and FIG. 4B, the core 10 of the present embodiment has connection surfaces 41, 42, 43, and 44 between each surface of the shaft portion 11 and the inner surface 31 of the first support portion 12 and the second support portion 13. The inner surface 31 of the first support portion 12 and the second support portion 13 includes the top inner surface 31*a*, the bottom inner surface 31*b*, and the side inner surfaces 31*c* and 31*d*. The connection surface 41 connects the top inner surface 31*a* and the upper surface 21 of the shaft portion 11. The connection surface 42 connects the bottom inner surface 31*b* and the lower surface 22 of the shaft portion 11. The connection surface 43 connects the side inner surface 31*c* and the side surface 23 of the shaft portion 11, and the connection surface 44 connects the side inner surface 31*d* and the side surface 24 of the shaft portion 11.

The connection surfaces 41, 42, 43, and 44 are concave cylindrical surface that is recessed toward the inside of the core 10. In the present embodiment, it is preferable that the curvature radius of the connection surfaces 41 and 42 be smaller than that of the connection surfaces 43 and 44. Accordingly, since the bottom surface 34 on which the first terminal electrode 51 and the second terminal electrode 52 are formed is selected from the surfaces of the first support portion 12 and the second support portion 13 where the curvature radius of connection surface connecting to each surface of the shaft portion 11 is relatively small, the Ag paste applied to the bottom surface 34 hardly wets up the shaft portion 11, and it is possible to suppress the proximity or adhesion of the first terminal electrode 51 and the second terminal electrode 52 to the winding portion 81 of the wire 80 wound around the shaft portion 11.

The relative relationship among angles formed by each surface of the first support portion 12 and the second support portion 13 and the inner surface 31, or the relative relationship among curvature radiuses of the connection surfaces between each surface of the first support portion 12 and the second support portion 13 and each surface of the shaft portion 11 may also be used when determining the orientation of the core 10, for example, before forming the first terminal electrode 51 and the second terminal electrode 52 on the core 10 in the manufacturing process of the wire wound inductor component 1. For example, a case will be considered in which the core 10 is irradiated with light from above, and the core 10 is photographed by an imaging device such as a camera from above, and the orientation of the core 10 is determined based on the obtained image data.

When light is radiated toward the core 10 from the upper side of the core 10, the light is reflected to other than the upper side of the core 10 from the inner surface 31 and the connection surfaces 41, 42, 43, and 44 of the core 10, and the inner surface 31 and the connection surfaces 41, 42, 43, and 44 are captured as a shadow in the image data obtained by the imaging device located above. Therefore, when the angles formed by each surface of the first support portion 12 and the second support portion 13 and the inner surface 31 or curvature radiuses of the connection surfaces between each surface of the first support portion 12 and the second support portion 13 and each surface of the shaft portion 11 are different between the cores 10, the orientation of the core 10 may be determined by the range or the darkness of the shadow located between the shaft portion 11 and the first support portion 12 and the second support portion 13 in the image data. Accordingly, by determining the orientation of the core 10 from the image data with an image recognition device or visual observation, the cores 10 may be aligned so that the bottom surface 34 of the first support portion 12 and the second support portion 13 is directed upward, and the application of the Ag paste to the first support portion 12 and the second support portion 13 may be made efficient.

Figure 5:
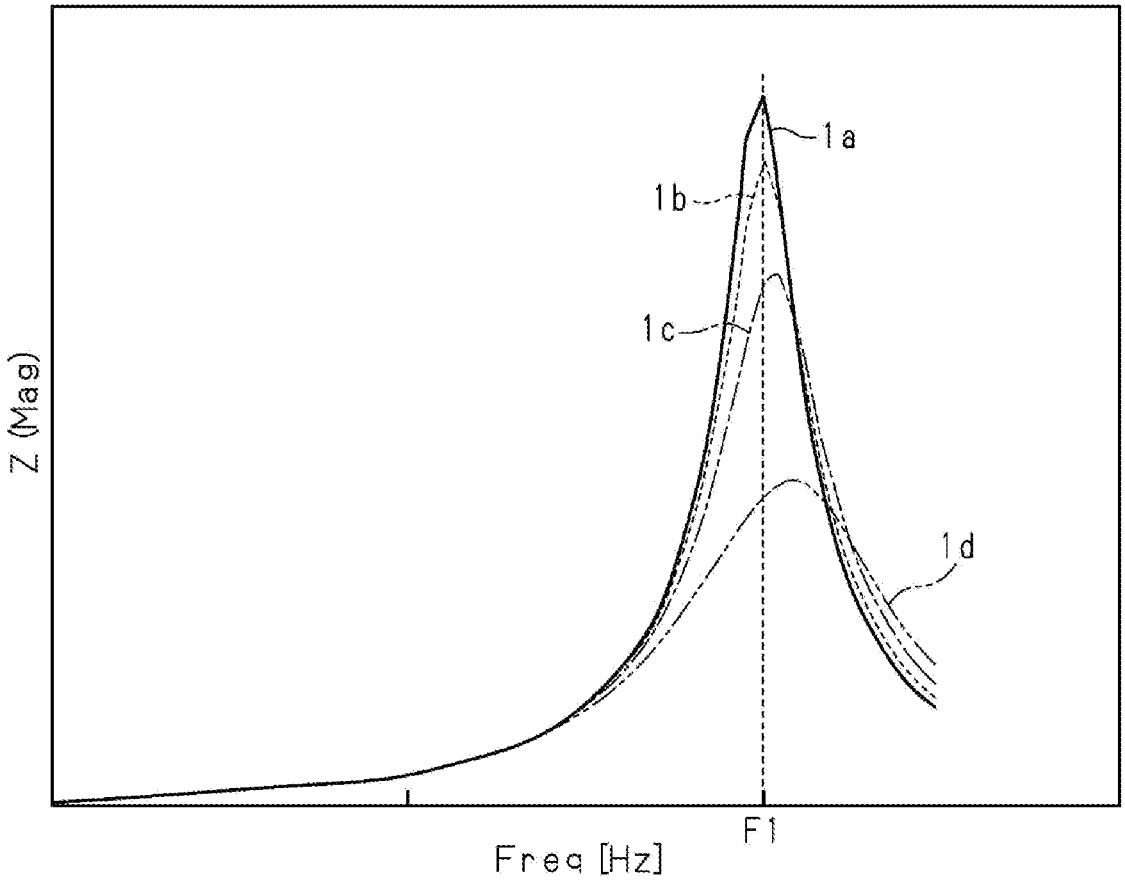
FIG. 5 is a frequency-impedance characteristics diagram of the wire wound inductor component.

FIG. 5 illustrates the frequency-impedance characteristics of four wire wound inductor components 1*a* to 1*d*, the top surface step D1 and the bottom surface step D2 have the same value in each of the four wire wound inductor components 1*a* to 1*d*, but the values of the top surface step D1 and the bottom surface step D2 are different between the four wire wound inductor components 1*a* to 1*d*. In FIG. 5, the horizontal axis represents the frequency labeled as Freq, and the vertical axis represents the impedance labeled as Z. The top surface step D1 and the bottom surface step D2 of the wire wound inductor component 1*a* are 25 μm. The top surface step D1 and the bottom surface step D2 of the wire wound inductor component 1*b* are 50 μm. The top surface step D1 and the bottom surface step D2 of the wire wound inductor component 1*c* are 85 μm. The top surface step D1 and the bottom surface step D2 of the wire wound inductor component 1*d* are 150 μm. In the four wire wound inductor components 1*a* to 1*d*, the outer dimensions and inductance values of the core are set to the same value. The length dimension L1 is 0.6 mm, and the width dimension W1 is 0.3 mm as the outer dimension, and an inductance value is 560 nH. As the top surface step D1 and bottom surface step D2 are smaller, the impedance value at self-resonant frequency F1 may be greater. Particularly when the top surface step D1 and the bottom surface step D2 are less than or equal to 50 μm, the cross-sectional area of the shaft portion 11 serving as an inner magnetic path may be sufficiently secured, so that sharp impedance characteristics may be obtained at high frequency such as self-resonant frequency, to be useful as a filter.

In the wire wound inductor component 1, it is preferable that the side surface step D3 be smaller than the top surface step D1. Thus, the cross-sectional area of the shaft portion 11 may further be increased without affecting the height dimension T1 of the core 10, thereby achieving both height reduction and securing of impedance characteristics at high frequency.

As described above, according to the present embodiment, the following advantages may be achieved.

(1) In the wire wound inductor component 1, the top surface step D1 and the bottom surface step D2 are the same, and the top surface step D1 and the bottom surface step D2 are less than or equal to 50 μm.

Since the top surface step D1 and the bottom surface step D2 are the same and are less than or equal to 50 μm, even when the wire wound inductor component 1 is reduced in size, the cross-sectional area of the shaft portion 11 may be secured. Thus, even when it is small in size, sharp impedance characteristics may be obtained at high frequency, and it is possible to achieve both size reduction and securement of impedance characteristics at high frequency. Further, since the cross-sectional area of the shaft portion 11 may be secured, the strength of the shaft portion 11 may be secured regardless of the small size. Additionally, by reducing the top surface step D1 and the bottom surface step D2, the cover member 90 may be made thinner. With this, the outer dimension of the wire wound inductor component 1 may be made smaller.

(2) The side surface step D3 is smaller than the top surface step D1. Thus, the cross-sectional area of the shaft portion 11 may further be increased without affecting the height dimension T1 of the core 10, thereby achieving both height reduction and securing of impedance characteristics at high frequency.

(3) The top surface step D1 is larger than the diameter of the wire 80. With this, when the resin to be the cover member 90 is applied to the upper surface 21 of the shaft portion 11, the wire 80 may easily be covered with the resin. Therefore, the wire 80 may be protected from a suction nozzle or the like which suctions the wire wound inductor component 1.

(4) By making the maximum height of the wire 80 higher than half of the top surface step D1, that is, higher than the central position between the upper surface 21 of the shaft portion 11 and the top surface 33 of the first support portion 12 and the second support portion 13, the cover member 90 may further be made thinner.

(5) The cover member 90 covers the top surface 33 of the first support portion 12 and the second support portion 13. With this, the adhesion strength of the cover member 90 to the core 10 may be improved.

(6) The curvature radius of the connection surfaces 41 and 42 is smaller than the curvature radius of the connection surfaces 43 and 44. With this, it is possible to suppress the proximity or adhesion of the first terminal electrode 51 and the second terminal electrode 52 to the wire 80 wound around the shaft portion 11. Further, in the manufacturing process of the wire wound inductor component 1, the orientation of the core 10 may be determined.

Modification

The above embodiment may be modified as follows.

The above embodiments and the following modifications may be implemented in combination with each other within a technically compatible range.

As a modification to the above embodiment, the cover member 90 may not cover the top surface 33 of the first support portion 12 and the second support portion 13, and may be disposed only between the first support portion 12 and the second support portion 13. Such a cover member covers the wire 80 wound around the shaft portion 11, and the top surface of the cover member has a plane shape in the same level with the top surface 33 of the first support portion 12 and the second support portion 13.

As a modification to the above embodiment, if only the end portion of the first terminal electrode 51 and the second terminal electrode 52 on the end surface 32 side is formed so as to have a highest height, a part in a portion from the end portion of the inner surface 31 side to the end portion of the end surface 32 side may be lowered.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire wound inductor component, comprising:

a core including a shaft portion that is columnar and extends in a first direction, and a first support portion and a second support portion respectively provided on a first end portion and a second end portion of the shaft portion in the first direction;

a first terminal electrode provided on the first support portion;

a second terminal electrode provided on the second support portion;

a wire wound around the shaft portion, the wire having a first end that is connected to the first terminal electrode and a second end that is connected to the second terminal electrode; and a cover member that is disposed at least between the first support portion and the second support portion and covers an upper surface of the shaft portion, wherein a distance between the upper surface of the shaft portion and a top surface of the first support portion and the second support portion in a second direction orthogonal to the first direction of the core is defined as a top surface step, a distance between a lower surface of the shaft portion and a bottom surface of the first support portion and the second support portion in the second direction of the core is defined as a bottom surface step, the top surface step and the bottom surface step are identical with each other, and the top surface step and the bottom surface step are less than or equal to 50 μm, the first terminal electrode and the second terminal electrode increase in height from end portions on sides of inner surfaces facing each other toward end portions on sides of end surfaces opposite to the inner surfaces of the first support portion and the second support portion, and heights of the first terminal electrode and the second terminal electrode at the end surfaces are higher than half of a height dimension of the core.

2. The wire wound inductor component according to claim 1, wherein a distance between a side surface of the shaft portion and a side surface of the first support portion and the second support portion in a third direction orthogonal to the first direction and the second direction of the core is defined as a side surface step, and the side surface step is smaller than the top surface step.

3. The wire wound inductor component according to claim 2, wherein the side surface step is less than or equal to 25 μm.

4. The wire wound inductor component according to claim 1, wherein the top surface step and the bottom surface step are less than or equal to 40 μm.

5. The wire wound inductor component according to claim 1, wherein the top surface step and the bottom surface step are less than or equal to 15% of a height dimension of the core.

6. The wire wound inductor component according to claim 5, wherein the top surface step and the bottom surface step are greater than or equal to 5% of the height dimension of the core.

7. The wire wound inductor component according to claim 1, wherein the top surface step and the bottom surface step are less than or equal to 10% of a width dimension of the core.

8. The wire wound inductor component according to claim 7, wherein the top surface step and the bottom surface step are greater than or equal to 5% of the width dimension of the core.

9. The wire wound inductor component according to claim 2, wherein the top surface step and the bottom surface step are less than or equal to 40 μm.

10. The wire wound inductor component according to claim 3, wherein the top surface step and the bottom surface step are less than or equal to 40 μm.

11. The wire wound inductor component according to claim 2, wherein the top surface step and the bottom surface step are less than or equal to 15% of a height dimension of the core.

12. The wire wound inductor component according to claim 3, wherein the top surface step and the bottom surface step are less than or equal to 15% of a height dimension of the core.

13. The wire wound inductor component according to claim 2, wherein the top surface step and the bottom surface step are less than or equal to 10% of a width dimension of the core.

14. The wire wound inductor component according to claim 3, wherein the top surface step and the bottom surface step are less than or equal to 10% of a width dimension of the core.

* * * * *